US010837097B2

(12) United States Patent
Narumiya et al.

(10) Patent No.: US 10,837,097 B2
(45) Date of Patent: Nov. 17, 2020

(54) NITRIDED PART AND METHOD OF PRODUCING SAME

(71) Applicant: NIPPON STEEL CORPORATION, Tokyo (JP)

(72) Inventors: Hiroki Narumiya, Tokyo (JP); Takahide Umehara, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/486,999

(22) PCT Filed: Feb. 20, 2018

(86) PCT No.: PCT/JP2018/006051

§ 371 (c)(1),
(2) Date: Aug. 19, 2019

(87) PCT Pub. No.: WO2018/151321

PCT Pub. Date: Aug. 23, 2018

(65) Prior Publication Data

US 2020/0024721 A1 Jan. 23, 2020

(30) Foreign Application Priority Data

Feb. 20, 2017 (JP) ..... 2017-029144

(51) Int. Cl.

| | |
|---|---|
| ***C23C 8/26*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/26*** | (2006.01) |

(52) U.S. Cl.

CPC ..... *C23C 8/26* (2013.01); *C22C 38/002* (2013.01); *C22C 38/02* (2013.01); *C22C 38/04* (2013.01); *C22C 38/06* (2013.01); *C22C 38/26* (2013.01)

(58) Field of Classification Search

CPC ..... C23C 8/26; C22C 38/06; C22C 38/002; C22C 18/02; C22C 38/04

See application file for complete search history.

(56) References Cited

U.S. PATENT DOCUMENTS

| | | | | |
|---|---|---|---|---|
| 2013/0273393 | A1* | 10/2013 | Imataka | C22C 38/22 428/684 |
| 2014/0034194 | A1 | 2/2014 | Imataka et al. | |
| 2015/0027591 | A1 | 1/2015 | Gyotoku et al. | |

FOREIGN PATENT DOCUMENTS

| | | | |
|---|---|---|---|
| JP | 9-279295 | A | 10/1997 |
| JP | 2012/36495 | A | 2/2012 |
| JP | 2013-19001 | A | 1/2013 |
| WO | WO 2012/105405 | A1 | 8/2012 |
| WO | WO 2013/140869 | A1 | 9/2013 |

OTHER PUBLICATIONS

International Preliminary Report on Patentability and English translation of the Written Opinion of the International Searching Authority (Forms PCT/IB/326, PCT/IB/373, and PCT/ISA/237) for International Application No. PCT/JP2018/006051, dated Aug. 29, 2019.
International Search Report (Form PCT/ISA/210) for International Application No. PCT/JP2018/006051 , dated May 22, 2018, with English translation.

* cited by examiner

*Primary Examiner* — Jessee R Roe
(74) *Attorney, Agent, or Firm* — Birch, Stewart, Kolasch & Birch, LLP

(57) ABSTRACT

A nitrided part having excellent fatigue strength which has predetermined constituents, has structures comprised of ferrite and pearlite, has ferrite grains with an aspect ratio of a ratio of a long axis direction and short axis direction of 4.5 or more present in the entire region at a depth from the surface of the part where stress is expected to concentrate of ($\rho \times 0.09+0.05$) mm or less, and has an average concentration of N of 5000 ppm or more at a surface layer part from the surface down to 200 μm in the depth direction.

8 Claims, 1 Drawing Sheet

【SHAPE OF TEST PIECE】

NITRIDED PART AND METHOD OF PRODUCING SAME

FIELD

The present invention relates to a nitrided part and a method of producing the same, more particularly relates to art for manufacturing a nitrided part having excellent bending fatigue strength.

BACKGROUND

In the past, it has been said that a gear produced by the cold forging has a higher strength than a gear produced by machining. This is due to the fact that at the time of cold forging, elongated grain structures are formed on the gear surface, so the tooth bases are high in fatigue strength.

However, no clear difference has appeared in fatigue strength between a gear manufactured by carburizing after cold forging and a gear manufactured by carburizing after machining. The reason is believed to be that in the heating process of carburizing, the elongated grain structures of pearlite and ferrite ($\alpha$) formed by cold forging end up disappearing due to phase transformation to austenite ($\gamma$).

To prevent such a phenomenon of disappearing elongated grain structures, it is effective to employ nitriding as it is not accompanied with phase transformation since the heating treatment is performed at a lower temperature than carburizing. Nitriding is advantageous since it maintains the elongated grain structures obtained by cold forging and enables improvement of the strength of the parts. For example, the art shown below is known.

Japanese Unexamined Patent Publication No. 9-279295 discloses steel for soft nitriding use excellent in cold forgeability characterized by having predetermined constituents and characteristics of a deep hardness HV after hot rolling or hot forging of 200 or less and a critical upset ratio in the subsequent cold forging of 65 or more. In this publication, in the state as hot rolled or hot forged, it is possible to obtain soft ferrite+bainite structures with an HV of 200 or less. It is considered that in subsequent cold forging, there is excellent cold forgeability with a critical upset ratio of 65% or more. Even in soft nitriding after cold forging, it is considered possible to rather increase the hardness by the aging effect without causing a drop in the core hardness of the base material.

SUMMARY

Technical Problem

Nitriding has the advantage of enabling a rise in the surface hardness to an HV of 1000 or more and has the advantage of a small heat treatment distortion since in general it is performed at the 600° C. or less $\alpha$ region and is not accompanied with phase transformation.

However, nitriding has the defect that compared with carburizing, which is performed in the 900° C. or more $\gamma$ region, the speed of diffusion of N atoms is slower and that if the treatment time is the same, the hardened layer is shallower in depth than when employing carburizing, so the bending fatigue strength is not sufficiently raised.

Further, if including, in the steel, V which reacts with the N at the time of nitriding to form fine precipitates, since the steel material softens at the time of cold forging, if spheroidally annealing it, the V is liable to react with the C in the steel and precipitate as VC. In this case, not only will the steel material not sufficiently be softened, but sufficient solid solution V will not remain in the steel at the time of nitriding after cold forging, so sufficient improvement in strength by the nitriding is liable to be unable to be expected.

The present invention was made in consideration of the above situation and has as its object the provision of a nitrided part having excellent fatigue strength by maintaining the elongated grain structures obtained in cold working even after nitriding in the case of application of nitriding, which has a small heat treatment distortion since not accompanied with phase transformation, to a cold worked part such as a cold forged part.

Solution to Problem

The inventors intensively studied nitrided parts maintaining elongated grain structures obtained in cold working even after nitriding and in turn having excellent fatigue strength and obtained the following findings:

(1) To secure cold workability, it is advantageous to reduce the amount of C together with the amount of Si and amount of Mn and further to include V so as to improve the hardness by nitriding.

(2) It is advantageous to make the final stand exit temperature in hot rolling 1050° C. or more to render all of the V contained a solid solution state and to make the average cooling rate between 900 to 500° C. faster than 0.4° C./s to suppress precipitation of VC.

(3) To secure cold workability, it is advantageous to hot roll a steel material of predetermined constituents, then slow the average cooling rate between 900° C. to 500° C. from 2.0° C./s to render the structures of the steel material and in turn the structures of the nitrided part structures made of ferrite and pearlite.

(4) It is advantageous to dissolve V in the steel material in a solid solution so as to prevent formation of recrystallized grains at the time of nitriding, in other words, maintain the elongated grains formed at the time of cold working even after nitriding, and to secure the presence of ferrite grains with an aspect ratio of a ratio of the long axis direction and short axis direction of 4.5 or more even at the nitrided part.

The present invention was completed based on the above finding. Its gist is as described below.

[1] A nitrided part comprising, by mass %, C: 0.05 to 0.20%, Si: 0.05 to 0.20%, Mn: 0.20 to 0.50%, P: 0.030% or less, S: 0.020% or less, and V: 0.10 to 0.50% and having a balance of Fe and unavoidable impurities, having structures consisting of ferrite and pearlite, having ferrite grains having an aspect ratio of a ratio of a long axis direction and short axis direction of 4.5 or more present in an entire region at a depth of ($\rho \times 0.09+0.05$) mm or less from a surface of a part where stress is expected to concentrate, and having an average concentration of N of 5000 ppm or more at a surface layer part from a surface down to 200 μm in a depth direction:

where, the $\rho$ is a radius of curvature (mm) of the part where stress is expected to concentrate.

[2] The nitrided part according to [1], further comprising, by mass %, at least one element selected from the group consisting of Mo: 0.10 to 0.50% and Nb: 0.01 to 0.05%.

[3] The nitrided part according to [1] or [2], further comprising, by mass %, at least one element selected from the group consisting of Cr: 0.1 to 2.0% and Al: 0.01 to 0.1%.

[4] A method of producing nitrided part comprising a step of hot rolling by a final stand exit temperature of 1050° C. or more a steel material of a composition comprising, by mass %, C: 0.05 to 0.20%, Si: 0.05 to 0.20%, Mn: 0.20 to 0.50%, P: 0.030% or less, S: 0.020% or less, and V: 0.10 to 0.50% and having a balance of Fe and unavoidable impurities, and cooling the steel material between 900° C. to 500° C. by 0.4 to 2.0° C./s, a step of cold working the steel material, without annealing, so that an aspect ratio of a ratio of a long axis direction and short axis direction of ferrite grains becomes 4.5 or more in an entire region with a depth of (ρ×0.09+0.05) mm or less from a surface of a part where stress is expected to concentrate, and a step of nitriding:

where, the ρ is a radius of curvature (mm) of the part where stress is expected to concentrate.

[5] The method of producing a nitrided part according to the above [4], wherein the part further comprises, by mass %, at least one element selected from the group consisting of Mo: 0.10 to 0.50% and Nb: 0.01 to 0.05%.

[6] The method of producing a nitrided part according to the above [4] or [5], wherein the part further comprises, by mass %, at least one element selected from the group comprising Cr: 0.1 to 2.0% and Al: 0.01 to 0.1%.

Advantageous Effects of Invention

In the nitrided part according to the present invention, the constituents, structures, aspect ratio of the ferrite grains, and average concentration of N at the surface layer part are suitably set. Further, in the method of producing a nitrided part according to the present invention, the constituents, final stand exit temperature in hot rolling, cooling conditions after hot rolling, and order of cold working and nitriding after dissolving V in the steel material in a solid solution are suitably set. As a result, according to the present invention, it is possible to realize a nitrided part having excellent fatigue strength by maintaining the elongated grain structures obtained in cold working even after nitriding in the case of application of nitriding, which has a small heat treatment distortion since not accompanied with phase transformation, to a cold worked part such as a cold forged part.

DESCRIPTION OF EMBODIMENTS

Figure 1:
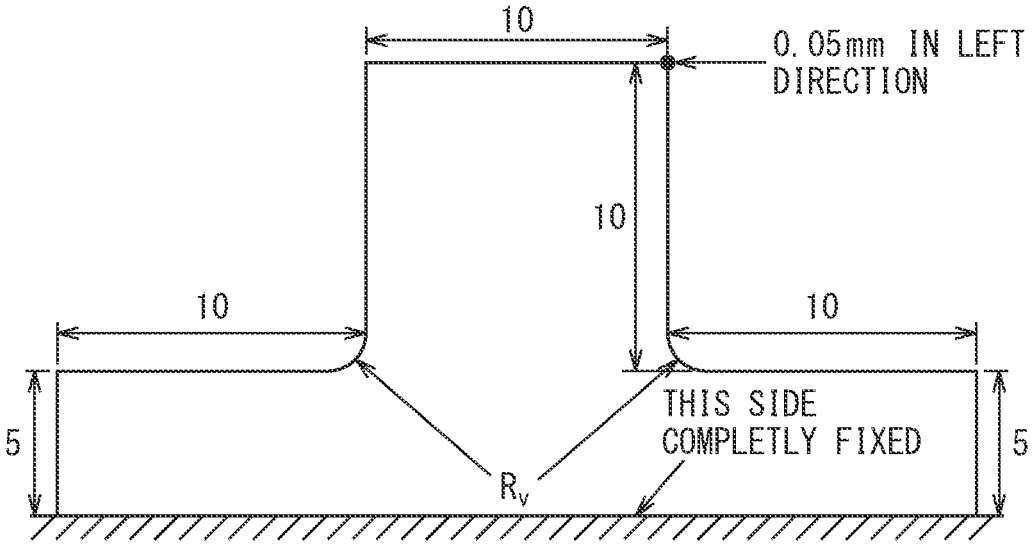
FIG. 1 is a view showing a finite element method analysis model for estimating a bending stress occurring at a rectangular tooth shape.

Below, embodiments of the present invention (nitrided part and method of producing same) will be explained in detail. These embodiments do not limit the present invention. Further, the constituent elements of the embodiments include ones able to be easily substituted by a person skilled in the art or ones substantially the same. Furthermore, the various aspects included in the embodiments can be freely combined in any self evident range.

Nitrided Part

Chemical Composition

The nitrided part of the present embodiment has the following chemical composition. Note that, the ratios (%) of the elements shown below all mean mass %.

Essential Constituents

C: 0.05 to 0.20%

Carbon (C) raises the strength of a nitrided part (in particular the strength of the core part). If the content of C is too low, this effect cannot be obtained. On the other hand, if the content of C is too high, the steel material becomes too high in strength, so the steel material falls in cold workability. Therefore, the content of C is 0.05 to 0.20%. The preferable lower limit of the content of C is 0.10%, while the preferable upper limit is 0.15%.

Si: 0.05 to 0.20%

Silicon (Si) has the action of raising the strength of the steel, but if the content is over 0.20%, the cold workability falls. On the other hand, making the content of Si less than 0.05% in mass production would result in ballooning costs. Therefore, the content of Si is 0.05 to 0.20%. From the viewpoint of the cold workability, the content of Si is preferably 0.15% or less.

Mn: 0.20 to 0.50%

Manganese (Mn) raises the strength of steel. Furthermore, Mn fixes the S in the steel as MnS to thereby keep FeS from being produced at the crystal grain boundaries. Due to this, red shortness is suppressed and hot rollability is improved. If the content of Mn is too low, these effects cannot be obtained. On the other hand, if the content of Mn is too high, the cold workability falls. Therefore, the content of Mn is 0.20 to 0.50%. The preferable lower limit of the content of Mn is 0.25%, while the preferable upper limit is 0.45%.

P: 0.030% or less

Phosphorus (P) is an impurity. P segregates at the grain boundaries to lower the grain boundary strength. As a result, the bending fatigue strength of the nitrided part falls. Therefore, the content of P is 0.030% or less. The preferable upper limit of the content of P is 0.025%. The content of P should be as low as possible.

S: 0.020% or less

Sulfur (S) is an impurity. If the content of S is too high, the S which was not fixed by Mn forms FeS at the grain boundaries whereby not only does the hot rollability fall, but also the large amount of MnS produced causes the cold rollability of the steel to fall and cracks to be liable to occur during cold working. Therefore, the content of S is 0.020% or less. The preferable upper limit of the content of S is 0.010%. The content of S should be as low as possible.

V: 0.10 to 0.50%

Vanadium (V) bonds with N to form fine precipitates by nitriding so as to improve the hardness near the surface so as to raise the fatigue strength of the nitrided part. Further, V has the effects of suppressing the recovery and recrystallization of the steel structures and maintaining the elongated grain structures produced due to cold working. If the content of V is too low, these effects are not obtained. On the other hand, if the content of V is over 0.50%, part of the V precipitates as VC and the effects start to become saturated. Therefore, the content of V is 0.10 to 0.50%. The preferable lower limit of the content of V is 0.2%, while the preferable upper limit is 0.4%.

The balance of the chemical composition of the above steel material is iron (Fe) and unavoidable impurities. The "unavoidable impurities" mean constituents mixed in from the ore or scrap utilized as the raw material of the steel or the environment of the manufacturing process and not constituents intentionally included in the steel material.

Optional Constituents

The steel material may also contain at least one of Mo, Nb, Cr, and Al.

Mo: 0.10 to 0.50%

Molybdenum (Mo) has the function of raising the strength of steel and of suppressing recovery and recrystallization of the steel structures and maintaining elongated grain structures formed by cold working. However, if the content of Mo is too high, the strength of the steel material excessively increases and the cold workability falls. Therefore, the content of Mo is preferably made 0.10 to 0.50%. The more preferable upper limit of the content of Mo is 0.40% while the more preferable lower limit is 0.20%.

Nb: 0.01 to 0.05%

Niobium (Nb) has the function of bonding with N and C in steel to form carbonitrides and of suppressing recovery and recrystallization of the steel structures by the carbonitrides and maintaining elongated grain structures formed by cold working. However, if the content of Nb is too high, the hardness of the material excessively rises and the workability when machining, forging, and otherwise working the part remarkably deteriorates. Further, if excessively containing Nb, the ductility at a 1000° C. or more high temperature region falls and becomes a cause of a drop in yield at the time of continuous casting and rolling. Therefore, the range of the content of Nb is preferably made 0.01 to 0.05%. The more preferable upper limit of the content of Nb is 0.04% and the still more preferable lower limit is 0.02%.

Cr: 0.1 to 2.0%

Chromium (Cr) has the function of bonding with N by nitriding to form fine precipitates and improve the hardness near the surface so as to raise the fatigue strength of the nitrided part. However, if the content of Cr is too high, at the time of nitriding. the N ends up reacting with the Cr whereby the dispersion of N into the steel is inhibited and the depth of the hardened layer becomes shallower. Therefore, the range of content of Cr is preferably 0.1 to 2.0%. The more preferable upper limit of the content of Cr is 1.0% and the still more preferable lower limit is 0.5%.

Al: 0.01 to 0.1%

Aluminum (Al) has the function of bonding with N by nitriding to form fine precipitates and improve the hardness near the surface so as to raise the fatigue strength of the nitrided part. However, if the content of Al is too high, hard, coarse $Al_2O_3$ is formed, the machineability of the steel falls, and further the fatigue strength also falls. Therefore, the content of Al is preferably made 0.01 to 0.1%. The more preferable lower limit of the content of Al is 0.02%. Further, the more preferable upper limit of the content of Al is 0.05%, while the extremely preferable upper limit value is 0.04%.

Structures

In the nitrided part of the present embodiment, the structures consist of ferrite and pearlite. Due to this, the strength of the steel material before nitriding is low, so cold working is possible. The effect is obtained that elongated grains can be formed by cold working. In turn, the fatigue strength of the nitrided part can be improved.

Here, the structures can be observed and identified as follows: That is, the surface or cross-sectional surface of the part is polished to a mirror finish, then is corroded by Nital. The white regions in observation by an optical microscope can be identified as ferrite, while the black and white stripe pattern regions or the black regions can be identified as pearlite.

Aspect Ratio of Ferrite Grains

In the nitrided part of the present embodiment, there are ferrite grains with an aspect ratio of the ratio of the long axis direction and short axis direction of 4.5 or more. This is proof that cold working such as cold forging is sufficiently performed. Accordingly, such a nitrided part naturally has excellent fatigue strength. Note that, this aspect ratio is preferably 20 or more, more preferably 100 or more.

Here, the aspect ratio of the ferrite grains can be derived as follows: That is, the aspect ratio, for example, can be measured and calculated by a 1000× optical microscope. Note that, when the aspect ratio is so extremely large that measurement of the aspect ratio by an optical microscope is difficult, it is possible to estimate the aspect ratio from the amount of the distortion component found by finite element method analysis of cold working.

Regions Where Elongated Ferrite Grains Are Present

In the cold forging of the present embodiment, at the entire region at the depth of (ρ×0.09+0.05) mm or less from the surface of the part where stress is expected to concentrate (ρ: radius of curvature of part where stress is expected to concentrate (mm)), the aspect ratio of the ratio of the long axis direction and short axis direction of the ferrite grains becomes 4.5 or more. Due to this, suitable predetermined ferrite elongated grains are obtained even after the later explained nitriding.

Note that, the method of derivation of the depth (ρ×0.09+0.05) mm from the surface of the part where stress is expected to concentrate is as follows:

That is, the depth "d" from the surface at the position of occurrence of a high bending stress of 0.8 time the bending stress of the surface of the nitrided part at the part where stress is expected to concentrate changes according to the magnitude of the radius of curvature ρ of the part where stress is expected to concentrate. The larger the ρ, the deeper, while the smaller the ρ, the shallower. Therefore, the inventors estimated the relationship between the region where a high bending stress occurs (depth "d") and the radius of curvature ρ of the part where stress is expected to concentrate by finite element method analysis. The analysis conditions are as follows:

FIG. 1 is a view showing a finite element method analysis model for estimating a bending stress occurring at a rectangular tooth shape. As shown in the figure, the analysis model was a two-dimensional model in the planar distortion state. In this model, two root corners at a width 10 mm, height 10 mm rectangular tooth shape were smoothly connected by arcs with a radius of curvature p to obtain an elastic member with a vertical modulus of elasticity of 213 GPa and a Poisson ratio of 0.3. This was divided into square elements. Further, the bottom side was completely fixed and displacement of 0.05 mm was given in the left direction to the top right corner at the rectangular tooth shape. The radius of curvature ρ was made three levels of 0.3 mm, 1 mm, and 3 mm.

As a result of analysis, when the radius of curvature ρ was 3 mm, the depth "d" at which a high bending stress occurs was 0.321 mm. Similarly, when the radius of curvature ρ was 1 mm, "d" was 0.145 mm, while when the radius of curvature ρ was 0.3 mm, "d" was 0.075 mm. Next, if linearly approximating the relationship between the radius of curvature ρ and the depth "d" by the least square method, the following equation (1) was obtained.

$$d=0.0904\times\rho+0.0507 \quad (1)$$

Therefore, in the present embodiment, based on the above equation (1), the region where elongated grains with an aspect ratio of 4.5 or more are formed was made the entire region at the depth of (ρ×0.09+0.05) mm or less from the surface of the part where stress is expected to concentrate:

$$d=0.09\times\rho+0.05 \quad (2)$$

Average Concentration of N of Surface Layer Part

In the nitrided part of the present embodiment, the average concentration of N of the surface layer part is 5000 ppm or more. Due to this, the effect is obtained that a large amount of nitrides precipitate and the surface layer part is improved in hardness and in turn the nitrided part can be raised in fatigue strength.

Here, the "surface layer part" means the part of the region in the range of the surface of the nitrided part down to 200 μm in the depth direction. Further, the average concentration of N can be measured by the following method. That is, first, the part is cut vertically to the surface to obtain a measurement sample. The observed surface is polished to a mirror finish. After that, the concentration of N in the range from the surface down to 200 μm in the depth direction (that is, the surface layer part) is measured in the depth direction at 0.5 μm pitches by an electron probe microanalyzer (EPMA) and the average concentration of N is calculated.

In the above way, according to the nitrided part of the present invention having a predetermined chemical composition and having structures, an aspect ratio of the ferrite grains, regions of presence of elongated ferrite grains, and an average concentration of N of the surface layer part all satisfying predetermined ranges, it is possible to realize excellent fatigue strength along with the above-mentioned effects.

Method of Producing Nitrided Part

The method of producing the nitrided part of the present embodiment includes at least a hot rolling step, cold working step, and nitriding step.

Hot Rolling Step

A steel material is obtained from cast steel adjusted to a chemical composition corresponding to the chemical composition of the above-mentioned nitrided part. Further, this steel material is used for hot rolling.

Final Stand Exit Side Temperature of Steel Material

In hot rolling, the final stand exit temperature of the steel material is made 1050° C. or more. Due to this, all of the V contained is made the solid solution state.

Cooling Rate After Hot Rolling

After hot rolling, the steel is immediately cooled in the atmosphere or air-cooled. Specifically, the average cooling rate between 900 to 500° C. is made 0.4° C./s or more to inhibit the precipitation of VC. Further, by making the average cooling rate between 900° C. to 500° C. 2.0° C./s or less, it is possible to prevent the formation of bainite. For this reason, the structures of the steel material cooled by this cooling rate condition and in turn the structures of the nitrided part become structures consisting of ferrite and pearlite.

Cold Working Step

The steel material hot rolled as explained above is then formed with a predetermined lubrication film for use for cold working. Note that, below, an example will be given of use of cold forging, in particular, in cold working.

Elimination of Annealing

If performing annealing in advance for the purpose of lowering the deformation resistance at the time of cold forging, VC precipitates. This VC ends up lowering the effect of inhibition of the recovery and recrystallization of the elongated grains due to the solid solution V at the time of nitriding intended by the present embodiment. Due to the above reasons, no annealing is performed before the cold forging in the present embodiment.

Cold Forging

In the present embodiment, parts are formed by cold forging. The cold forging is performed to raise the degree of working of part where stress is expected to concentrate where stress concentrates at the time when the nitrided part is actually used.

Here, the "part where stress is expected to concentrate" is the part where it is expected that a large stress will be applied during operation in the nitrided part. In general, it is the portion with a small curvature. For example, the boundary between the boss and flange in a flange with a boss, the bottom of teeth of the gear, and portions where stress concentrates in the same way as these may be mentioned as parts where stress is expected to concentrate.

In the cold forging of the present embodiment, the aspect ratio of the ratio of the lengths in the long axis direction and short axial direction of the ferrite grains is made to become 4.5 or more at the entire region at a depth of (ρ×0.09+0.05) mm or less from the surface of the part where stress is expected to concentrate (ρ: radius of curvature of part where stress is expected to concentrate (mm)). Due to this, suitable predetermined ferrite elongated grains can be obtained even after the later explained nitriding.

Nitriding Step

The part obtained by cold working (cold forging) as explained above is then used for nitriding.

The nitriding in the present embodiment may be treatment under any conditions so long as treatment whereby the average concentration of N of the surface layer part from the surface of the nitrided part down to 200 μm in the depth direction becomes 5000 ppm or more. In the present embodiment, as explained above, since a predetermined amount of V is made to form a solid solution in the steel material, even if nitriding in this way, no recrystallized grains are formed, the elongated grains formed by cold working are maintained, and ferrite grains with an aspect ratio of a ratio of the long axis direction and short axis direction of 4.5 or more can be made present in the nitrided part.

As explained above, according to the method of producing the nitrided part of the present embodiment of selecting a predetermined chemical composition and setting a suitable cooling condition after hot rolling, final stand exit temperature at hot rolling, and order of cold working and nitriding after forming a solid solution of V in the steel material, the combination of the above-mentioned effects enables a nitrided part having an excellent fatigue strength to be obtained.

EXAMPLES

Fabrication of Nitrided Part

Hot Rolling

Steel materials "a" to "s" were formed from cast steel adjusted to the chemical compositions of "a" to "s" shown in Table 1 and hot rolled to obtain φ60 mm Hot Rolled Steel Bars "a" to "s". Note that, the final stand exit temperature at the hot rolling was made one described in Table 1.

After the end of hot rolling, the Hot Rolled Steel Bars "a" to "s" were measured for Vickers hardness (HV). The results are shown in Table 1.

TABLE 1

| Sample | C [mass %] | Si [mass %] | Mn [mass %] | P [mass %] | S [mass %] | V [mass %] | Mo [mass %] | Nb [mass %] | Cr [mass %] | Al [mass %] | Final stand exit side temperature [° C.] | Cooling rate between 900° C. to 500° C. [° C./s] | Hardness after rolling [HV] |
|---|---|---|---|---|---|---|---|---|---|---|---|---|---|
| A | 0.14 | 0.08 | 0.31 | 0.021 | 0.012 | 0.24 | | | | | 1070 | 0.5 | 147 |
| B | 0.08 | 0.15 | 0.29 | 0.012 | 0.009 | 0.24 | 0.25 | | | | | | 155 |
| C | 0.18 | 0.12 | 0.22 | 0.016 | 0.017 | 0.44 | | 0.03 | | | | | 162 |
| D | 0.16 | 0.07 | 0.36 | 0.022 | 0.015 | 0.20 | | | 0.18 | | | | 154 |
| E | 0.11 | 0.10 | 0.27 | 0.011 | 0.012 | 0.39 | | | | 0.04 | | | 158 |
| f | 0.08 | 0.14 | 0.29 | 0.012 | 0.010 | 0.23 | 0.25 | 0.04 | | | | | 159 |
| g | 0.17 | 0.12 | 0.23 | 0.016 | 0.017 | 0.42 | | 0.03 | 0.51 | | | | 164 |
| h | 0.16 | 0.07 | 0.35 | 0.022 | 0.015 | 0.19 | | | 0.19 | 0.07 | | | 159 |
| i | 0.24 | 0.15 | 0.22 | 0.018 | 0.008 | 0.43 | | | | | | | 178 |
| j | 0.17 | 0.28 | 0.31 | 0.015 | 0.014 | 0.41 | | | | | | | 173 |
| k | 0.15 | 0.09 | 0.61 | 0.024 | 0.007 | 0.35 | | | | | | | 177 |
| l | 0.14 | 0.06 | 0.45 | 0.041 | 0.014 | 0.28 | | | | | | | 154 |
| m | 0.11 | 0.14 | 0.41 | 0.022 | 0.015 | 0.04 | | | | | | | 141 |
| n | 0.14 | 0.08 | 0.31 | 0.021 | 0.012 | 0.24 | | | | | 1020 | | 146 |
| o | 0.14 | 0.08 | 0.31 | 0.021 | 0.012 | 0.24 | | | | | 970 | | 152 |
| p | 0.14 | 0.08 | 0.31 | 0.021 | 0.012 | 0.24 | | | | | 1070 | | 147 |
| q | 0.14 | 0.08 | 0.31 | 0.021 | 0.012 | 0.24 | | | | | | | 147 |
| r | 0.14 | 0.08 | 0.31 | 0.021 | 0.012 | 0.24 | | | | | | | 147 |
| s | 0.14 | 0.08 | 0.31 | 0.021 | 0.012 | 0.24 | | | | | | | 147 |

As clear from Table 1, the Test Pieces "a" to "h" and "l" to "s" were all judged to have low hardnesses after rolling of less than 170HV and to be excellent in cold workability. Conversely, the Test Pieces "i" to "k" were all judged to have high hardnesses after rolling of 170HV or more and to be inferior in cold workability.

Cold Forging

Next, notches were formed at predetermined locations of the hot rolled steel bars (parts where stress is expected to concentrate). Hot Rolled Steel Bars "a" to "o" and Hot Rolled Steel Bars "q" to "s" were formed with notches by cold forging, while the Hot Rolled Steel Bar "p" was formed with a notch by machining.

If forming notches at the Hot Rolled Steel Bars "a" to "o" and Hot Rolled Steel Bars "q" to "s", first roughly shaped test pieces were cut out from the hot rolled steel bars and predetermined lubrication coatings were formed. After that, the test pieces were cold forged by punching by a plate-shaped punch of a width 4 mm, height 10 mm, and depth 40 mm with edge parts at the bottom surface rounded by a radius of curvature of 2 mm. Note that, the amount of punching by the plate-shaped punch was as shown in Table 2.

TABLE 2

| Sample | Method of forming notch | Amount of punching by plate shaped punch [mm] |
|---|---|---|
| A | Cold forging | 7.7 |
| B | | |
| c | | |
| d | | |
| e | | |
| f | | |
| g | | |
| h | | |
| i | | |
| j | | |
| k | | |
| l | | |
| m | | |
| n | | |
| o | | |
| p | Machining | — |
| q | Cold forging | 2.0 |
| r | | 3.2 |
| s | | |

After forming notches with a radius of curvature of 2 mm in the Test Pieces "a" to "o" and the Test Pieces "q" to "s" in this way, the test pieces were finished by machining based on the notches to end the formation of the notches. Note that, the Test Piece "r" was finished by machining based on the notch cut deeper by 0.5 mm by machining so as to make the depth of the region where elongated grains with an aspect ratio of 4.5 or more were formed 0.15 mm. Further, the Test Piece "s" was finished by machining based on the notch cut deeper by 0.4 mm depth by machining so as to make the depth of the region where elongated grains with an aspect ratio of 4.5 or more were formed 0.25 mm. Note that, the bottom of the notch was the part where stress concentrated in the subsequent four point bending fatigue test. The radius of curvature of the notch was 2 mm, so the depth "d" at which a high bending stress occurred of 0.8 time or more the bending stress of the surface-most part became 0.23 mm.

As opposed to this, if notching the Hot Rolled Steel Bar "p", a rough shaped test piece was cut out from the Hot Rolled Steel Bar "p" and machined at ordinary temperature.

Nitriding

The thus notched Test Pieces "a" to "s" were nitrided. The nitriding in each case was performed at 570° C. for 5 hours. The nitriding potential Kn was made 0.6 and oil quenching was performed at 90° C.

Evaluation of Performance of Nitrided Part

The nitrided part obtained in the above way was investigated for (I) whether the structures consisted of ferrite and pearlite, (II) whether ferrite grains with an aspect ratio of the ratio of the long axis direction and short axis direction of 4.5 or more were present in the entire region at a depth of 0.23 mm from the surface of the bottom of the notch, and (III) average concentration of N (ppm) of the surface layer part from the surface down to 200 μm in the depth direction and was investigated for (IV) the fatigue life of a four point bending test (cycles) at a maximum load of 12 kN. The results are shown in Table 3.

The average aspect ratio of the elongated grains at the surface layer part was calculated by cutting out any cross-section at the surface layer part, picking out ferrite grains able to be seen on this cut cross-section at 20 points, measuring the aspect ratio of the ferrite grains, then finding their average. Note that, Samples "a" to "l", "n", and "o"

were difficult to measure for aspect ratio by an optical microscope, so the aspect ratio was calculated from the amount of strain found by finite element method analysis.

Figure 2:
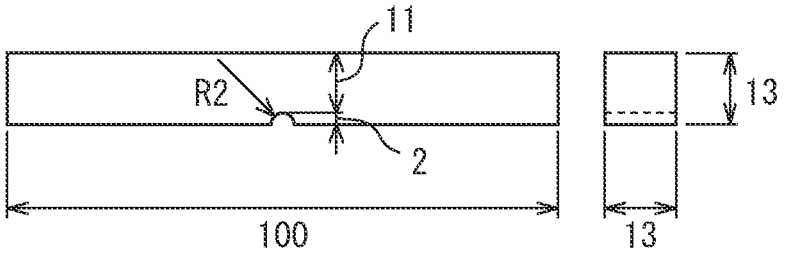
FIG. 2 is a view showing a shape of a four-point bending fatigue test piece and a load in a four test point bending fatigue test.
Figure 2:
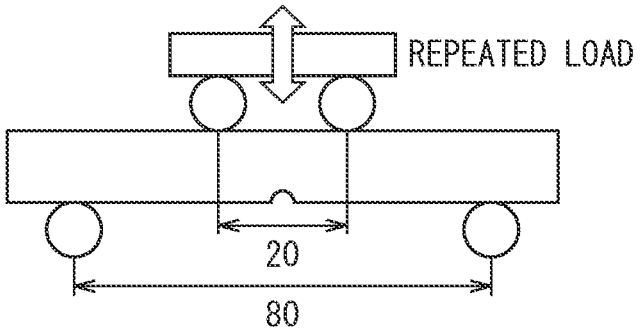

Further, the fatigue life of the four-point bending test was measured as followed: FIG. 2 is a view showing a shape of a four-point bending fatigue test piece and a load in a four test point bending fatigue test. As shown in the figure, a 13 mm square cross-section×100 mm length test piece was formed as explained above by cold forging and machining (Samples "a" to "o" and "q" to "s") or machining (Sample "p"). Next, a lower side supporting point was placed at the 80 mm position and the upper side supporting point was placed at the 20 mm position sandwiching a notch with a radius of curvature of 2 mm formed at the center point of length of the test piece and a repeated load was applied to the upper side supporting point. For the test machine, a 10 tonf Servopulsar made by Shimadzu Corporation was used. A 12 kN load was repeatedly applied at 10 Hz and the fatigue test life (number of repetitions required for breaking test piece) was investigated. At this time, the minimum load was set to 0.6 kN corresponding to 5% of the maximum load of 12 kN.

TABLE 3

| Sample | Structures (consisting of ferrite and pearlite?) | Ferrite grains with aspect ratio of 4.5 or more present at entire region at depth from surface of notch bottom of 0.23 mm or less? | Average concentration of N of surface layer part from surface down to 200 μm in depth direction [ppm] | Fatigue life of four point bending test at maximum load of 12 kN [cycles] |
|---|---|---|---|---|
| a | Yes | Yes | 5948 | 2287 |
| b | | Yes | 8041 | 1904 |
| c | | Yes | 8580 | 4217 |
| d | | Yes | 6039 | 3451 |
| e | | Yes | 7543 | 2415 |
| f | | Yes | 7184 | 2499 |
| g | | Yes | 8587 | 3803 |
| h | | Yes | 6411 | 3811 |
| i | | Yes | 7642 | 2561 |
| j | | Yes | 6083 | 2874 |
| k | | Yes | 5482 | 2185 |
| l | | Yes | 5286 | 905 |
| m | | No | 2440 | 513 |
| n | | Yes | 4828 | 1569 |
| o | | Yes | 4314 | 1492 |
| p | | No | 5247 | 1115 |
| q | | No | 5489 | 1385 |
| r | | No | 5364 | 1450 |
| s | | Yes | 6114 | 2049 |

As clear from Table 3, Samples "a" to "k" and "s" for which good results were obtained for all of the above Items (I) to (III) were all judged to give excellent results (1900 cycles or more) in fatigue life of a four-point bending test (cycles) at maximum loads of 12 kN of the above Item (IV). As opposed to this, Samples "l" to "r" for which good results were not obtained for one or more of the above Items (I) to (III) were all judged to not give excellent results in fatigue life of a four-point bending test (cycles) at maximum loads of 12 kN of the above Item (IV).

The invention claimed is:

1. A nitrided part comprising, by mass %, C: 0.05 to 0.20%, Si: 0.05 to 0.20%, Mn: 0.20 to 0.50%, P: 0.030% or less, S: 0.020% or less, and V: 0.10 to 0.50% and having a balance of Fe and unavoidable impurities, having structures consisting of ferrite and pearlite, having ferrite grains having an aspect ratio of a ratio of a long axis direction and short axis direction of 4.5 or more present in an entire region at a depth of (ρ×0.09+0.05) mm or less from a surface of a part where stress is expected to concentrate, and having an average concentration of N of 5000 ppm or more at a surface layer part from a surface down to 200 μm in a depth direction:

where, the ρ is a radius of curvature (mm) of the part where stress is expected to concentrate.

2. The nitrided part according to claim 1, further comprising, by mass %, at least one element selected from the group consisting of Cr: 0.1 to 2.0% and Al: 0.01 to 0.1%.

3. The nitrided part according to claim 1, further comprising, by mass %, at least one element selected from the group consisting of Mo: 0.10 to 0.50% and Nb: 0.01 to 0.05%.

4. The nitrided part according to claim 3, further comprising, by mass %, at least one element selected from the group consisting of Cr: 0.1 to 2.0% and Al: 0.01 to 0.1%.

5. A method of producing nitrided part comprising a step of hot rolling by a final stand exit temperature of 1050° C. or more a steel material of a composition comprising, by mass %, C: 0.05 to 0.20%, Si: 0.05 to 0.20%, Mn: 0.20 to 0.50%, P: 0.030% or less, S: 0.020% or less, and V: 0.10 to 0.50% and having a balance of Fe and unavoidable impurities, and cooling the steel material between 900° C. to 500° C. by 0.4 to 2.0° C./s, a step of cold working the steel material, without annealing, so that an aspect ratio of a ratio of a long axis direction and short axis direction of ferrite grains becomes 4.5 or more in an entire region with a depth of (ρ×0.09+0.05) mm or less from a surface of a part where stress is expected to concentrate, and a step of nitriding:

where, the ρ is a radius of curvature (mm) of a part where stress is expected to concentrate.

6. The method of producing a nitrided part according to claim 5, wherein the part further comprises, by mass %, at least one element selected from the group consisting of Cr: 0.1 to 2.0% and Al: 0.01 to 0.1%.

7. The method of producing a nitrided part according to claim 5, wherein the part further comprises, by mass %, at least one element selected from the group consisting of Mo: 0.10 to 0.50% and Nb: 0.01 to 0.05%.

8. The method of producing a nitrided part according to claim 7, wherein the part further comprises, by mass %, at least one element selected from the group consisting of Cr: 0.1 to 2.0% and Al: 0.01 to 0.1%.

* * * * *